US006254443B1

(12) United States Patent
Payne

(10) Patent No.: US 6,254,443 B1
(45) Date of Patent: Jul. 3, 2001

(54) REPLACEABLE TOWER SUPPORT FOR A BEARING RACE AND DRIVE SHAFT IN A MARINE ENGINE

(75) Inventor: Leonard R. Payne, Parker, AZ (US)

(73) Assignee: L & L Tech, Inc., Parker, AZ (US)

( * ) Notice: Subject to any disclaimer, the term of this patent is extended or adjusted under 35 U.S.C. 154(b) by 0 days.

(21) Appl. No.: 09/375,632

(22) Filed: Aug. 17, 1999

(51) Int. Cl.[7] ..... B63H 23/34

(52) U.S. Cl. ..... 440/83; 440/74; 440/76; 440/78

(58) Field of Search ..... 440/74, 76, 78, 440/83; 384/616

(56) References Cited

U.S. PATENT DOCUMENTS 4,767,225 * 8/1988 Iio ..... 384/616
4,792,315 * 12/1988 Karrasch et al. ..... 440/83
4,917,639 * 4/1990 Onoue ..... 440/76
4,925,414 * 5/1990 Newman ..... 440/83
5,112,259 * 5/1992 McElroy, Jr. et al. ..... 440/83
5,171,177 * 12/1992 Hubbell ..... 440/78
5,411,423 * 5/1995 Higby ..... 440/83

* cited by examiner

*Primary Examiner*—S. Joseph Morano
*Assistant Examiner*—Lars A. Olson
(74) *Attorney, Agent, or Firm*—Willie Krawitz

(57) ABSTRACT

A housing for an outdrive is installed with a replaceable tower support for a ball bearing race through which the drive shaft rotates. When the bearing race becomes worn, rather than replacing the entire housing and installing a new bearing race, only the tower support and worn bearing race is removed and replaced, which represents a considerable cost saving.

6 Claims, 2 Drawing Sheets

REPLACEABLE TOWER SUPPORT FOR A BEARING RACE AND DRIVE SHAFT IN A MARINE ENGINE

BACKGROUND OF THE INVENTION

This invention relates to a new and improved replaceable tower support for a bearing and drive shaft, and having particular use for propeller drive shafts in the housing of motor boat outdrives.

Usually, when the bearing support for a propeller drive shaft becomes worn, the entire housing for the drive shaft and worn bearing support must be replaced with a new housing and bearing race and the original drive shaft, and represents an expensive proposition. Typical publications concerning these types of motors are noted in U.S. Pat. Nos. 4,276,036; 4,798,548; 4,948,384; 4,986,775; 5,018,999; 5,094,639; and, 5,407,508.

However, none of these patents disclose or infer the capability for replacement of only a worn ball bearing race and/or support member from the housing of a marine outdrive without requiring replacement of the entire housing and its components. The capability of effecting such a replacement would represent a considerable saving since a marine outdrive housing has a wear lifetime significantly longer than either of the above two components, and is much more expensive.

THE INVENTION

According to the invention, there is provided a marine outdrive housing and replaceable support tower for bearings and a race seated thereon, the bearings being suitable for engaging a drive shaft such as a propeller drive shaft positioned in the marine outdrive. The tower comprises a hollow, elongate structure whose lower end will usually rest on a machined portion of the housing floor, or the tower may be mounted within the interior portion of the marine outdrive. The upper end of the tower is circularly shaped, and typically will project into the propeller shaft cavity to enable direct engagement with drive gears.

Mounting the tower structure into the housing may involve any one of the following steps: 1. heating the outdrive housing to about 350° F.–450° F. and chilling the bearing tower, for example to about freezing, e.g., 30° F.–32° F., followed by press fitting the tower into the housing as an interference fit; or, 2. threading the housing and tower, and screwing the tower into the housing; or, 3. securing the tower with a mechanical device such as a pin and bolt. However, since steps 2 and 3 require machining, they tend to be more expensive than press fitting.

DESCRIPTION OF THE PREFERRED EMBODIMENTS

Figure 1:
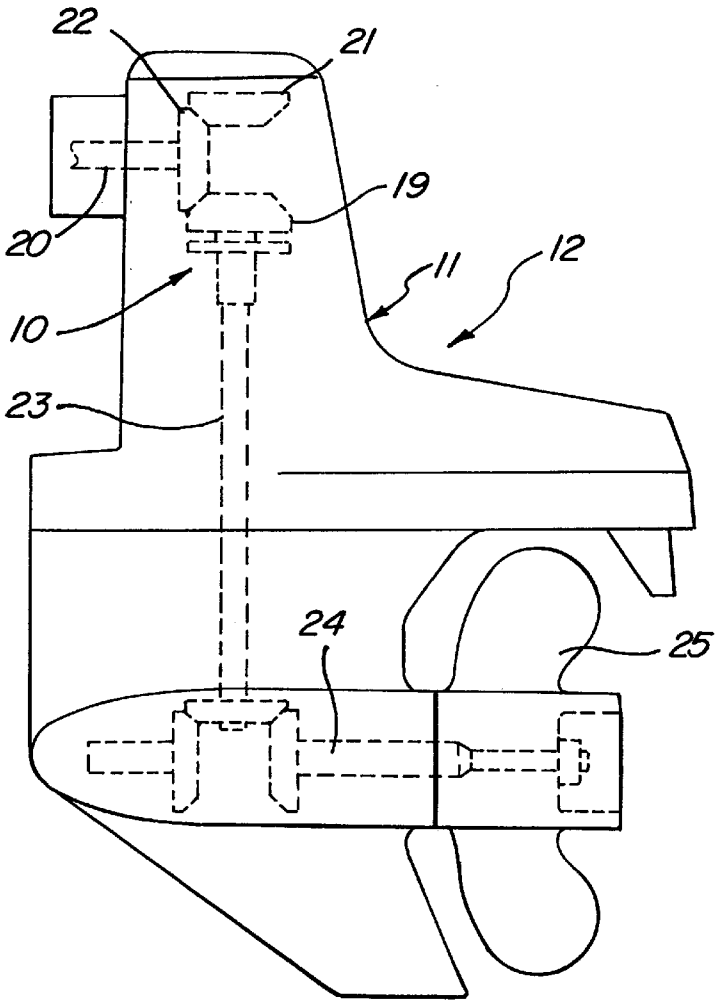
FIG. 1 is an external side elevation view, partly in cross section illustrating the tower support structure of this invention, which mount bearings and a race for vertical engagement with a drive for a propeller shaft.
Figure 3:
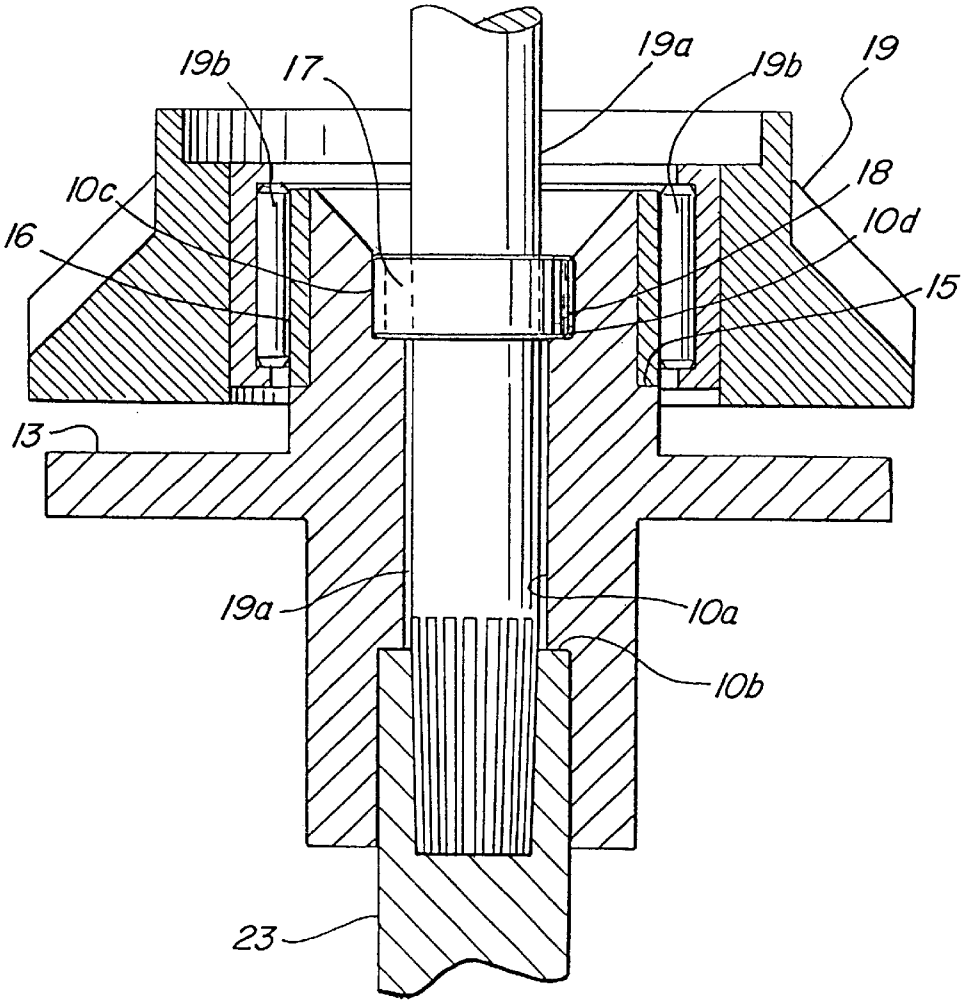
FIG. 3 is a side elevation view in axial section showing an enlarged view of the support tower structure of this invention, shown in FIG. 1; and, FIG. 4 is a cut-away perspective, showing the tower support of this invention mounted within a housing of a marine engine for horizontal engagement with a marine drive shaft and gear.
Figure 2:
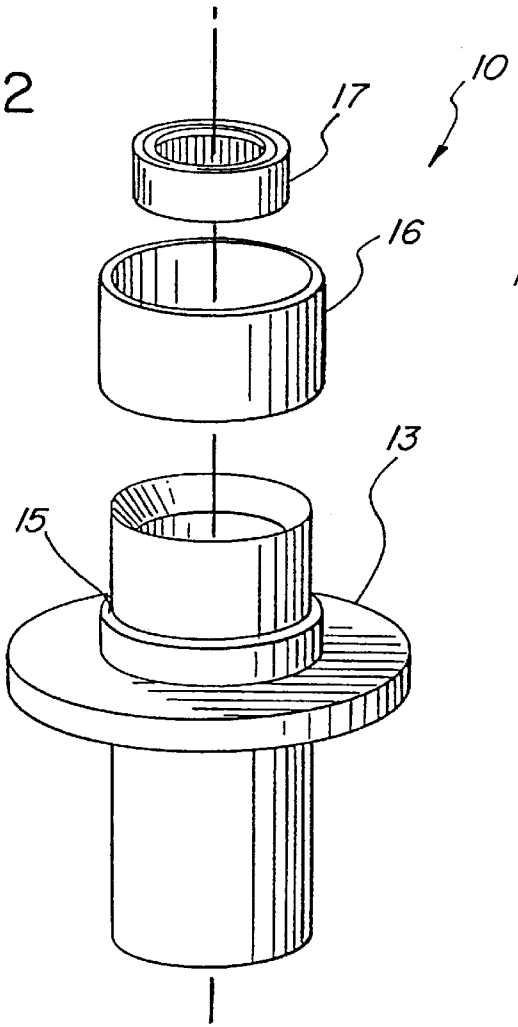
FIG. 2 is an exploded, external, perspective view of the tower support structure of this invention, and the bearings and race for rotational support of a propeller shaft and gear.

One embodiment of the tower support 10 of this invention is shown in FIGS. 1–3, mounted within a housing 11 of a marine outdrive 12. An integrally formed, or machined extension or flange 13 is provided medially of the tower support 10, the flange being secured within a ledge or groove (see FIG. 4) of the housing to stabilize the tower support against excessive movement such as vibration.

The tower 10 provides a circular support shoulder 15 machined around the flange base, an interior bore 10*a* having a lower machined cut-out shoulder 10*b*, and a machined channel 10*c* terminated by a cut-out shoulder 10*d*. A bearing race 16 is mounted on the support shoulder 15, and bearings 17 are mounted circumferentially in channel 10*c*, and supported on shoulder 10*d*.

A gear drive 19 with a centrally mounted shaft 19*a* and needle bearings 19*b* is seated on, and overrides the bearing race 16, and is driven by an engine drive shaft 20, through gear drives 21, 22. In effect, drive shaft 20 and gear drives 19, 21 and 22 are supported by tower 10. Bearings 17 rotatably center and stabilize shaft 19*a* which is spline connected to a vertical shaft 23 which connects through bevel gears to a propeller drive shaft 24 for rotation of a propeller 25. Shaft 19*a* of gear drive 19 is mounted within interior bore 10*a* of the tower, and the end of shaft 19*a* is supported on lower shoulder 10*b*.

Figure 4:
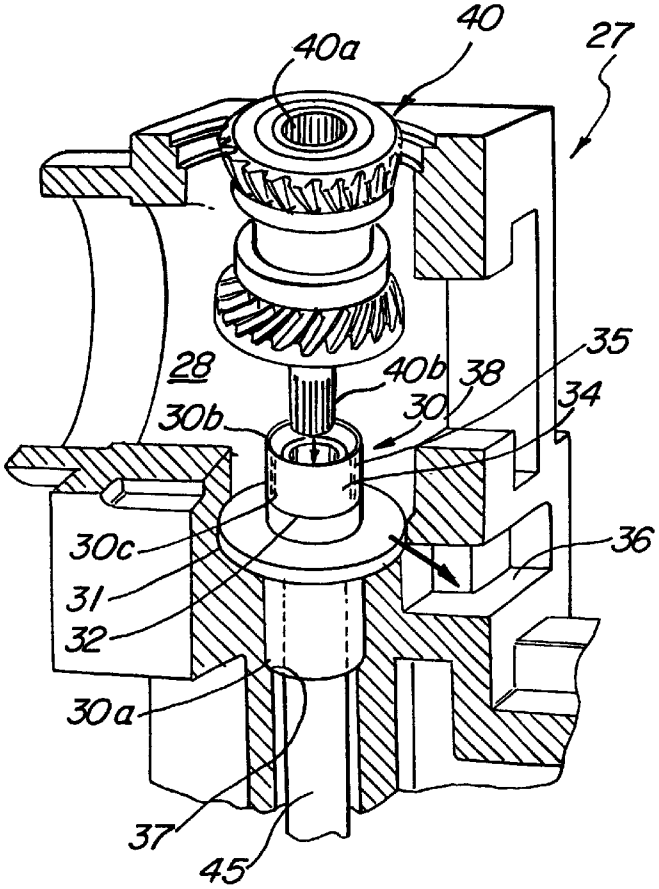

The replaceable tower support of this invention is preferably used in a marine engine known as the BRAVO, and is shown in FIG. 4. In this embodiment, the tower 30 is press fitted as an interference fit into the housing 27 of the outdrive and projects into the propeller drive cavity 28 for horizontal connection to a propeller drive and propeller (not shown).

The tower defines a lower end 30*a*, an upper end 30*b*, and an interior channel 30*c*. Similar to the tower 10, the tower 30 is machined to form a flange 31 and a groove or shoulder 32, the latter supporting a bearing race 34; the interior channel 30*c* is configured to support bearings 35. A circular groove 36 is machined in the housing 27 into which flange 31 is seated, (see arrow) and a circumferential shoulder 37 is machined along the inner wall of the housing to support lower end 30*a* of the tower. The groove 36 and shoulder 37 support the flange and lower end of the tower respectively, and these two supports secure the tower in housing 27, to reduce vibration of the gear drive and engine.

A gear assembly 40 is mounted on, and overrides the bearing race 34, and the gear assembly horizontally engages and rotates a propeller drive and propeller (not shown) leading from an exhaust 38. For purposes of illustration, the gear assembly 40 is shown only slightly larger relative to the support tower 30, but the actual size of the gear assembly is considerably larger than the tower, itself.

The gear assembly 40 includes needle bearings 40*a* which are seated on, and override the bearing race 34, and the gear assembly also includes a centrally mounted shaft end 40*b* which rotates through, and is centered by the bearings 35 in the interior channel 30*c* of the tower 30. The shaft end 40*b* of the gear assembly rests on, and is supported by the lower end 30*a* of the tower. The shaft end 40*b* is in turn spline connected to, and is supported by an idler shaft 45 which is mounted on bearings (not shown) that are set into a machined portion at the bottom of the BRAVO housing 27. Thus, the upper portion of the gear assembly 40 is supported by the bearing race 34 and the tower 30, and is supported on its lower shaft side by the tower and the idler shaft 45. In the embodiments shown in FIGS. 1 and 4, the gear and drive system are essentially that of the BRAVO drive.

The replaceable tower support itself may be constructed of a suitable corrosion resistant, load bearing steel such as a 304 stainless, a 4140 machine steel, etc. Typical dimensions of the tower support are approximately 2.5–10 inches in overall height and, about 3–5 inches in overall diameter; flange element 31 is about 1–5 inches wide and about 0.2 inches thick; the shoulder 32 (or 15) is about 0.05–0.07 inches wide; and, the circular groove 36 in housing 27 is about 150 mils in depth.

These dimensions and materials of construction (supra) are sufficiently adequate to significantly improve present horsepower mounting characteristics, and an increase in tower dimensions will obviously impart even greater ruggedness, and further improve horsepower carrying capability, if desired.

What is claimed is:

1. An assembly of a replaceable tower and a bearing race and circumferential bearings for supporting gear drives and shaft components for a marine engine out-drive contained in an outdrive housing defining an upwardly disposed propeller drive cavity, the tower at its medial rim and lower end being secured within the housing along respective, circular recessed grooves of the housing, securement of the tower within the housing including one of the following: press fitting, threading, and a pin and bolt connection; the tower comprising: a hollow, cylindrically-shaped, tubular element defining upper and lower ends; a flange formed medially of the tower support, the flange defining base and rim portions; a circular shoulder support formed around the base portion of the flange; and a channel cut-out circumferentially formed inside the upper end of the tubular element; the shoulder support being configured for supporting the bearing race, and the channel cut-out being configured for securement therein of the circumferential bearings; whereby: the bearing race is arranged and configured to support the gear drives and a centrally mounted shaft extending from the gear drives, and shaft components; the gear drives horizontally engaging a propeller drive shaft connected to a propeller, both being mounted within the propeller drive cavity; the bearings are arranged and configured to support, center and rotatably secure therein the centrally mounted shaft; the centrally mounted shaft is supported along a lower shoulder of the tubular element and by an idler shaft, the flange being secured along its medial rim within a recessed circular groove of the housing; the tower thereby being secured into the housing with reduced vibration of the gear drives and engine the tower, bearings and bearing race being removable and replaceable when they become worn.

2. The assembly of claim 1, in which the dimensions of the replaceable tower are: about 2.5–10 inches in overall height; the flange is about 1–5 inches wide and about 0.2 inches thick; the shoulder support is about 0.07 inches wide; and, the medial circular groove in the housing is about 150 mils in depth.

3. A method for supporting gear drives and shaft components contained in a housing of a marine outdrive engine, the housing defining an upwardly disposed propeller drive cavity, comprising: mounting a replaceable tower support within the housing, securement of the tower support within the housing including one of the following: press fitting, threading and a pin and bolt connection; the tower support defining a hollow, cylindrically shaped, tubular element defining upper and lower ends, a flange formed medially of the tower support, the flange defining base and rim portions, a circular shoulder support formed around the base portion of the flange, and a channel cut-out circumferentially formed inside the upper end of the tubular element, the shoulder support being configured for support of a bearing race, and the channel cut-out being configured for securement therein by circumferentially arranged bearings; which comprises supporting by the bearing race: gear drives, a centrally mounted shaft extending from the gear drives, and shaft components; horizontally engaging the gear drives with a propeller drive shaft, both. being mounted within the propeller drive cavity; centering, securing and rotatably supporting the centrally mounted shaft with the bearings; supporting the centrally mounted shaft along a lower shoulder of the tubular element, and by an idler shaft, securing the flange along the rim within a medial circular recessed groove of the housing, its the lower end of the tower support being secured within a lower circular groove of the housing, thereby securing the tower support into the housing with reduced vibration of the gear drives and engine; and, removing and replacing the tower support, bearings and bearing race when they become worn.

4. The method of claim 3, in which the dimensions of the replaceable tower support are: about 2.5–10 inches in overall height; the flange is about 1–5 inches wide and about 0.2 inches thick; the shoulder support is about 0.07 inches wide; and, the medial circular groove in the housing is about 150 mils in depth.

5. An assembly of a replaceable support tower, circumferential bearings and a bearing race, and supported gear drives, a centrally mounted shaft extending from the gear drives, the gear drives and drive shafts for a marine engine outdrive contained in an out-drive housing, the housing defining an upwardly disposed propeller drive cavity, the support tower at its media rim and lower end being secured within the housing along respective recessed grooves of the housing, securement of the support tower within the housing including one of the following: press fitting, threading, and a pin and bolt connection, the support tower comprising:

a hollow, cylindrically-shaped, tubular element defining upper and lower ends, a flange formed medially of the support tower, the flange defining base and rim portions, a shoulder support formed around the base portion of the flange, and a channel cut-out circumferentially formed inside the upper end of the tubular element, the shoulder support being configured for support of the bearing race, and the channel cut-out being configured for securement therein of the circumferential bearings, whereby: the bearing race is arranged and constructed to support the gear drives, the centrally mounted shaft and the drive shafts, the gear drives horizontally engaging a propeller drive shaft connected to a propeller, both being mounted within the propeller drive cavity and the circumferential bearings are arranged and configured to support, center and rotatably secure therein the centrally mounted shaft, the centrally mounted shaft is supported along a lower shoulder of the tubular element, and by an idler shaft, the flange being secured along the rim within the recessed circular groove of the housing, and along its lower end within a circular groove of the housing, the support tower thereby being secured into the housing with reduced vibration of the gear drives and engine; the support tower, bearings and bearing race being removable and replaceable when they become worn.

6. The assembly of claim 5, in which the dimensions of the support tower are: about 2.5–10 inches in overall height; the flange is about 1–5 inches wide and about 0.2 inches thick; the shoulder support is about 0.07 inches wide; and, the medial circular groove in the housing is about 150 mils in depth.

* * * * *